United States Patent [19]

Bourboulis

[11] 4,008,546

[45] Feb. 22, 1977

[54] BUILDING CONSTRUCTION

[76] Inventor: Panagiotis Bourboulis, 236 Uxbridge Road, Hayes, Middlesex, England

[22] Filed: Apr. 22, 1976

[21] Appl. No.: 679,236

[52] U.S. Cl. ..... 52/65; 52/71

[51] Int. Cl.[2] ..... E04B 1/346

[58] Field of Search ..... 52/64, 65, 67, 70, 71, 52/222; 206/44 R, 45.12, 45.31

[56] References Cited

UNITED STATES PATENTS

| | | | |
|---|---|---|---|
| 568,041 | 9/1896 | Quackenboss | 52/65 |
| 1,953,418 | 4/1934 | Macdonald | 206/44.12 |
| 2,019,778 | 11/1935 | Enholm | 229/14 C |
| 2,200,934 | 5/1940 | Platt | 52/64 |
| 2,727,620 | 12/1955 | Buttery | 206/45.31 |
| 2,765,497 | 10/1956 | Ludowici | 52/70 |
| 2,858,581 | 11/1958 | Doane | 52/64 |
| 2,920,920 | 1/1960 | Couse | 52/70 |
| 3,012,291 | 12/1961 | Rice | 52/70 |
| 3,206,897 | 9/1965 | Hilker | 52/71 |
| 3,348,344 | 10/1976 | Tatevossian | 52/293 |
| 3,388,515 | 6/1968 | Gruettner | 52/222 |
| 3,434,249 | 3/1969 | Richey | 52/65 |
| 3,476,240 | 11/1969 | Howell | 229/93 |
| 3,645,052 | 2/1972 | Hanna | 52/64 |

FOREIGN PATENTS OR APPLICATIONS

| | | | |
|---|---|---|---|
| 1,570,416 | 2/1966 | France | 52/70 |
| 383,780 | 3/1908 | France | 52/65 |
| 655 | 3/1854 | United Kingdom | 52/70 |

*Primary Examiner*—Ernest R. Purser
*Assistant Examiner*—Henry Raduazo
*Attorney, Agent, or Firm*—Kane, Dalsimer, Kane, Sullivan and Kurucz

[57] ABSTRACT

A building is constructed so that its appearance both exteriorly and interiorly may be altered from one shape to another at the desire of the owner utilizing essentially the same materials. In an exemplary embodiment, panels forming sections of the building walls may be shifted from an original position to a second position at which not only the appearance of the building changes but the function of the enclosed space and floor area may be different.

5 Claims, 8 Drawing Figures

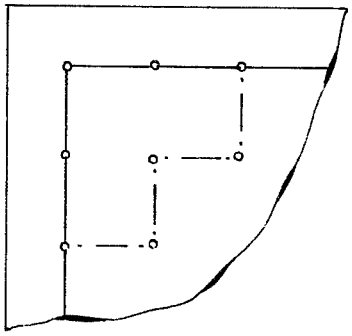
FIG. 5
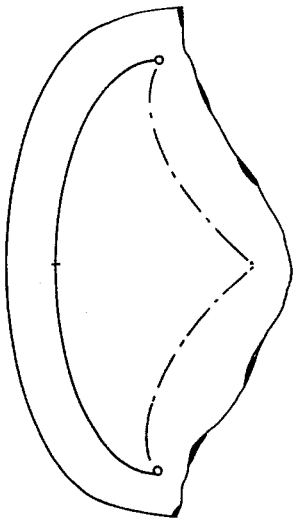
FIG. 6
FIG. 7
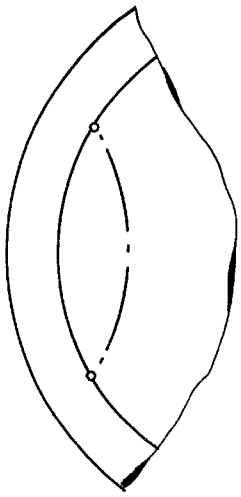
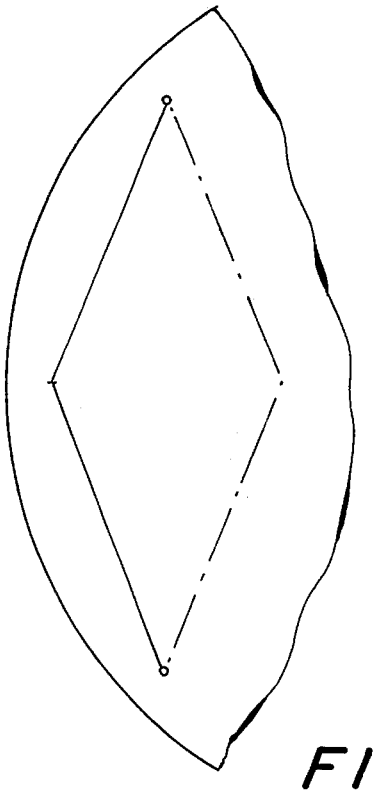
FIG. 8

BUILDING CONSTRUCTION

SUMMARY OF THE INVENTION

The principal object of this invention is to provide a building construction having the capability of altering its appearance both exteriorly and interiorly from one shape to another at the desire of the building's owner utilizing essentially the same materials. This ability may apply for any structure whether it be employed as an office building, hotel, apartment building, residence or any other type of enclosure. Although the building's shape and appearance may be altered, this invention provides for the maintenance of the original architectual design. In changing from one shape to another, the invention provides for the ability to alter the subdivision of the building interior within a relatively short period of time at the discretion of the owner while utilizing original building materials and maintaining costs at an absolute minimum. With the foregoing in mind, principal of building construction may be standardized so that construction and alteration time and cost are drastically reduced. In addition, the ability and versatility to alter the shape and appearance of a building is of extreme psychological importance to the owner as well as occupant thereof.

These and other objects and advantages will become apparent from the following detailed description which is to be taken in conjunction with the accompanying drawings which are only included for purposes of showing exemplary embodiments and for a better understanding of this invention.

BRIEF DESCRIPTION OF THE DRAWINGS

In the drawings:

FIG. 5 is a fragmentary schematic view of another example of a corner construction following the teachings of this invention;

FIG. 6 is a fragmentary schematic view of a building structure the side walls of which traverse parabolic or elliptical curves with the teachings of the present invention incorporated therein;

FIG. 7 is a fragmentary schematic view of a circular structure having at least one part of the circumference thereof shiftable to alter the shape and appearance thereof; and FIG. 8 is a fragmentary schematic view of a structure having more than four sides in which the sides are shiftable to alter the structures, shape and appearance.

DESCRIPTION OF THE PREFERRED EMBODIMENT

Figure 1:
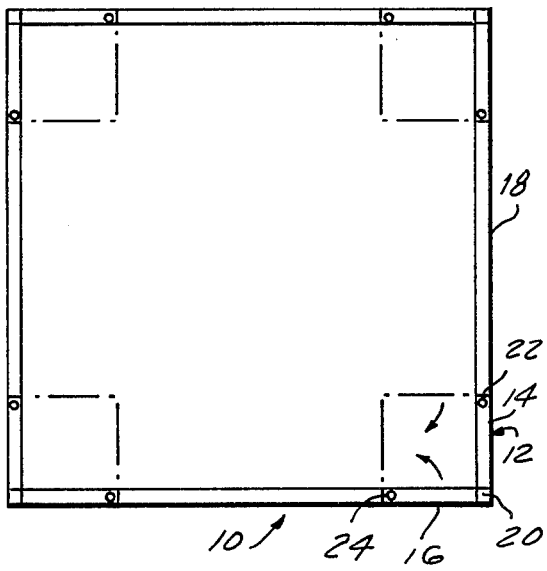
FIG. 1 is a top plan view of an exemplary building structure incorporating the teachings of this invention with corner panels adapted to be shifted to the position represented by phantom lines in altering the appearance and shape of the building.

In the representative embodiment of the present invention illustrated in the drawings, a building 10 may include one or more means for altering the shape and appearance of both the exterior and interior; and as illustrated the corners 12 may include movable panels 14 and 16 forming part or partitions of the walls 18 that may be of the same or different construction and materials whether it be typical building sheet material, plywood panelling, glass, wood, metal or the like.

Figure 3:
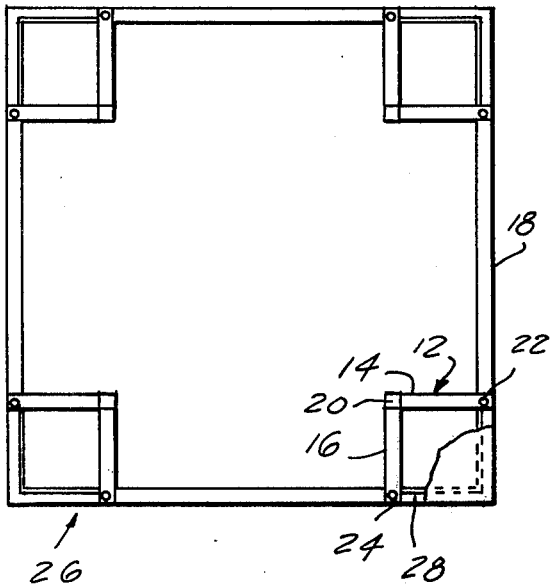
FIG. 3 is similar to FIG. 1 but showing the side panels after they have been moved with a major portion of the ceiling removed and with rails mounted at the building corners to form terraces or patios.
Figure 2:
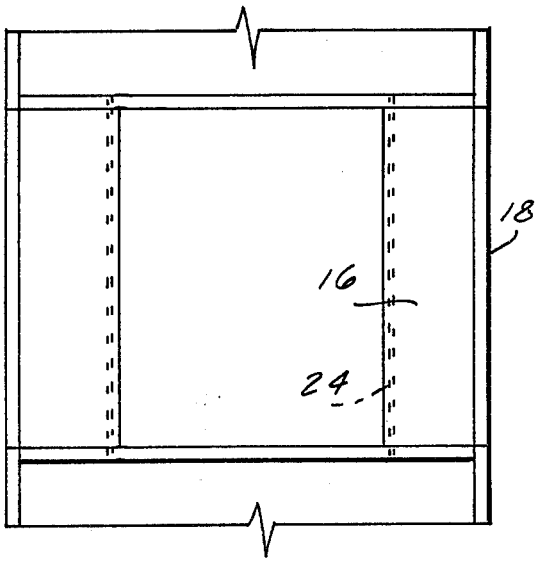
FIG. 2 is a fragmentary side elevational view of one floor of the building shown in FIG. 1.
Figure 4:
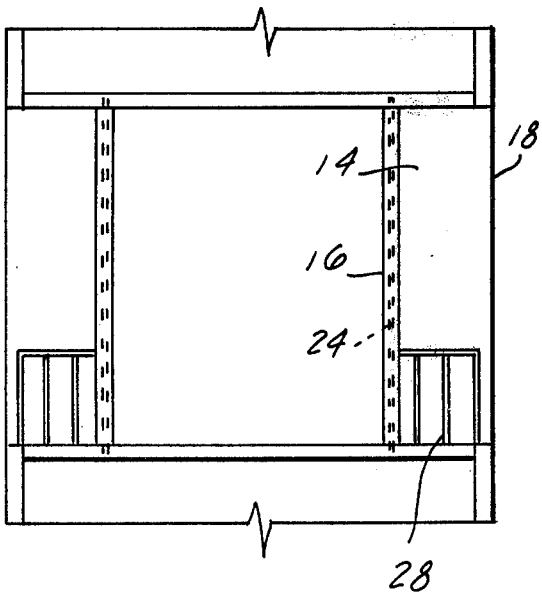
FIG. 4 is a fragmentary side elevational view of the structure of FIG. 3.

The corner posts 20 in the illustrated embodiment may be a separate member or form part of one of the panels 14, 16. The panels 14 and 16 may be shifted in several ways at the discretion of the building designer, architect, or owner and as illustrated hinges 22 and 24 may be conveniently located to facilitate the panel movement. The relocation of the panels 14 and 16 are represented by the phantom lines in FIG. 1 and as solid lines in FIGS. 3 and 4. Obviously any other form of connection between the panels and the associated wall 18 may be utilized. After the panels 14 and 16 have been shifted to their new positions, the newly created space area or enclosure 26 may be utilized in any manner at the discretion of the building owner. For example, space 26 may be converted into a terrace or patio having a guardrail 28 as shown. Accordingly, the shifting of the panels 14 and 16 in the exemplary embodiment may be accomplished to take advantage of the change of seasons. Thusly, the configuration shown in FIGS. 1 or 2 may be adapted during the winter months whereas the configuration of FIG. 3 and 4 may be adapted during the summer months.

Other approaches and means for altering the shape and appearance of a building construction within the spirit of the present invention may be made. In this connection, reference is made of FIGS. 5 - 8 wherein other examples of structures are shown, the appearance and shape of which may be altered and changed. Thus, in FIG. 5 the corner of a rectangle or square building may be shifted inwardly to form four wall surfaces. Obviously, the corners can be comprised of many more panels to form any multiple of wall surfaces.

In FIG. 6 a parabolic or eliptical building may have a portion of its outer surface shiftable to alter the structures shape and appearance. In this example the curved wall sections are maintained in the altered structure if desired.

In FIG. 7 a circular structure is provided with part of the circumference thereof shiftable inwardly to form a concavity in the wall surfaces.

In FIG. 8 a structure having more than four walls as for example a hexagon or octagon shaped building in which the wall sections are shiftable inwardly to alter the structure's shape and appearance.

Thus it will be readily understood by those skilled in the art that a building construction is provided that is capable of having its appearance altered both exteriorly and interiorly from one shape to another at the desire of the building's owner utilizing essentially the same building materials. This may be accomplished for any building no matter what its use, whether it be an office building, resident building, apartment building hotel, home or any other building enclosure. Furthermore, the present invention contemplates the ability to convert from an office building to an apartment building and vice versa or the ability to subdivide a building into smaller units and vice versa. In this connection, the illustrated representative building layout may be subdivided in many different ways and may be used for one or many purposes.

As will be readily apparent to those skilled in the art, the proposed building construction is able to coordinate the altered appearance with the original architectural design in a relatively short period of time at minimum cost and expense at the discretion of the owner. Furthermore, the cost of altering the building appearance is far less than that required for a structure of similar volume utilizing prior art techniques. By standardization of the proposed principals of construction provided by the present invention construction time and costs are drastically reduced.

In order to provide for soundproofing against noises generated both externally and internally, the panels 14 and 16 and for that matter walls 18 may incorporate suitable soundproofing material. It is further contemplated by the present invention that the panels 14 and 16 be so constructed and arranged to permit any further or required electrical or plumbing system for the altered construction to blend or be compatible with the existing electrical and plumbing network, respectively. Provisions may also be introduced for fire retardation as well as optimum heat exchange conditions not only before but after the building alteration as well.

Thus, the several aforenoted objects and advantages are most effectively attained. Although several exemplary embodiments have been disclosed and described in detail herein, it should be understood that this invention is in no sense limited thereby and its scope is to be determined by that of the appended claims.

What is claimed is:

1. An improved building construction including at least one first juncture, a fixed floor and a fixed ceiling, a pair of fixed walls joining said floor and ceiling and extending toward said juncture, means for permitting the alteration of the building's appearance both exteriorly and interiorly from one shape to another at the desire of the building's owner and for his psychological benefit utilizing essentially the same building materials within a relatively short and reduced period of time at minimum cost and expense to the owner while coordinating the altered appearance with the original architectural design, said means including a pair of movable wall portions, said movable wall portions meeting at said juncture and enclosing a first peripheral area of the building construction adjacent said juncture connecting means connecting said movable wall portions to said fixed walls at a locations spaced from the juncture and said movable wall portions being shiftable about said connecting means and being thus movable from a first position which encloses the first peripheral area to a second position so as to open and expose the first peripheral area to thereby change the enclosed space and accordingly alter the shape and appearance of the building.

2. The invention in accordance with claim 1, wherein in one position of the parts the plan of the building is rectangular and in the other of the positions the plan includes more than four side walls.

3. The invention in accordance with claim 1, wherein the building includes more than four side walls before shifting the parts.

4. The invention in accordance with claim 1, wherein the wall is parabolic in shape and the movable part is outwardly convex at both positions.

5. The invention in accordance with claim 1, wherein the wall is circular and the shiftable part is inwardly concave after being shifted.

* * * * *